United States Patent [19]

Kitai et al.

[11] 4,079,581

[45] Mar. 21, 1978

[54] ALARM DEVICE FOR CLOCKS

[75] Inventors: Kiyoshi Kitai, Tokyo; Masuo Ogihara, Chiba; Kozo Sato, Chiba; Nobuo Shinozuki, Chiba, all of Japan

[73] Assignee: Seiko Koki Kabushiki Kaisha, Japan

[21] Appl. No.: 555,837

[22] Filed: Mar. 6, 1975

[30] Foreign Application Priority Data

Mar. 8, 1974 Japan ..... 49-26875

[51] Int. Cl.[2] ..... G04C 21/16; H01H 43/10

[52] U.S. Cl. ..... 58/21.155; 58/19 A; 58/38 R; 200/37 R

[58] Field of Search ..... 58/19 R, 19 A, 21.15, 58/21.155, 22.5, 38 R, 57.5; 200/36, 37 R

[56] References Cited

U.S. PATENT DOCUMENTS

| | | | |
|---|---|---|---|
| 2,192,377 | 3/1940 | Hofe | 58/21.155 |
| 2,244,924 | 6/1941 | Thorson | 58/21.155 |
| 3,683,614 | 7/1970 | Komiyama | 58/5 |
| 3,686,878 | 8/1972 | Patrick et al. | 58/21.155 |
| 3,738,098 | 6/1973 | Scheer | 58/19 R |
| 3,851,458 | 12/1974 | Schwab | 58/19 A |

*Primary Examiner*—Edith S. Jackmon

*Attorney, Agent, or Firm*—Robert E. Burns; Emmanuel J. Lobato; Bruce L. Adams

[57] ABSTRACT

An alarm device of a clock has an alarm time detection mechanism coacting with the time wheels of the clock for detecting a preset alarm time and sound an audible alarm. The audible alarm is terminated in response to manual depression of a call time setter pin and with each depression of the pin, the alarm time detection mechanism is reset to detect a new alarm time so that the new alarm time is determined by the number of times the pin is depressed. A time indicating mechanism indicates the preset alarm time and is automatically adjusted to display the new alarm time dependent upon the number of depressions of the call time setter pin.

6 Claims, 6 Drawing Figures

ALARM DEVICE FOR CLOCKS

BACKGROUND OF THE INVENTION

This invention relates to clocks provided with a call time system or alarm device for announcing preset call or alarm times and, more particularly, to improvements in the call time setter for repeatedly setting call times to be announced.

Heretofore, various call time setters of the aforementioned type have been proposed. However, any of these call time setters requires various associated mechanisms to be provided independent of the call time system, which is disadvantageous not only in view of the complications of the mechanism but also in view of space factor and cost. Further, in the prior-art systems the call time interval from the stopping of the announcement of a call time by pushing a stop button till the announcement of the next call time is set to a constant period (for instance 10 minutes) and cannot be freely altered by the user, which is rather inconvenient in use.

The present invention, accordingly, has an object of providing a novel call time setter which overcomes the prior-art drawbacks and also provides novel effects.

One object of the present invention is to provide a call time setting mechanism that can be obtained by making use of most of the parts of the mechanism used in the prior-art call time system and by adding an actuating member for stopping the alarm and setting the call time whereby the mechanism is extremely simplified and is advantageous in view of the space factor and cost.

A further object of the invention is to provide call time detection members that can be displaced step by step each for unit displacement by repeatedly operating the actuating member so that the user can freely alter the call time interval to suit his desire.

A further object of the invention is to provide a call time setting mechanism which can correctly display the preset call time set by the call time setting operation and which can correctly display the call time even in the case where the call time has been altered.

A still further object of the invention is to provide a locking member which automatically locks the call time setter in an inoperative state when the call time system is rendered inoperative by the alarm set operating means so that even if the call time setter member is pushed by mistake after the setting of a call time, the preset call time will not be altered.

BRIEF DESCRIPTION OF THE DRAWING

The drawing illustrates several embodiments of the invention, and in which.

DETAILED DESCRIPTION OF THE INVENTION

Figure 1:
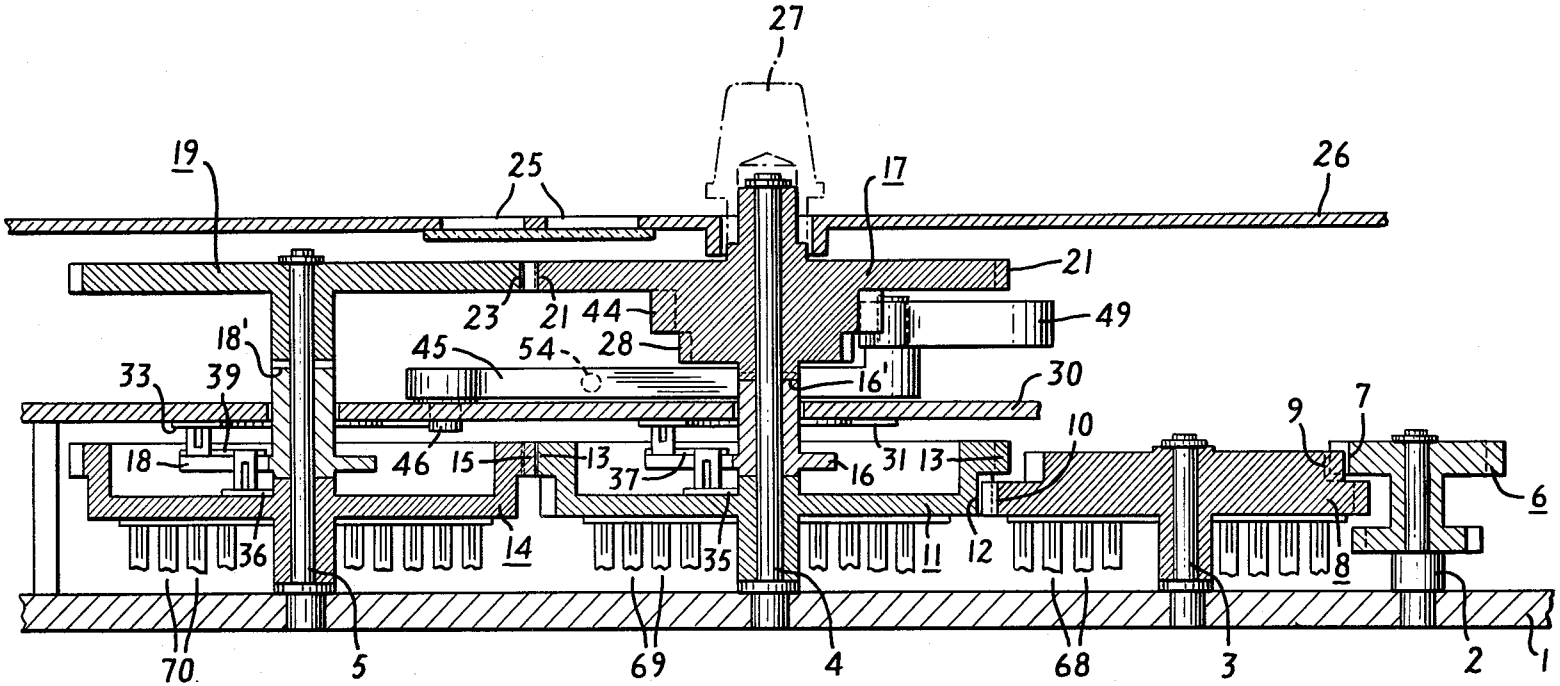
FIG. 1 is a sectional view of part of a clock.
Figure 2:
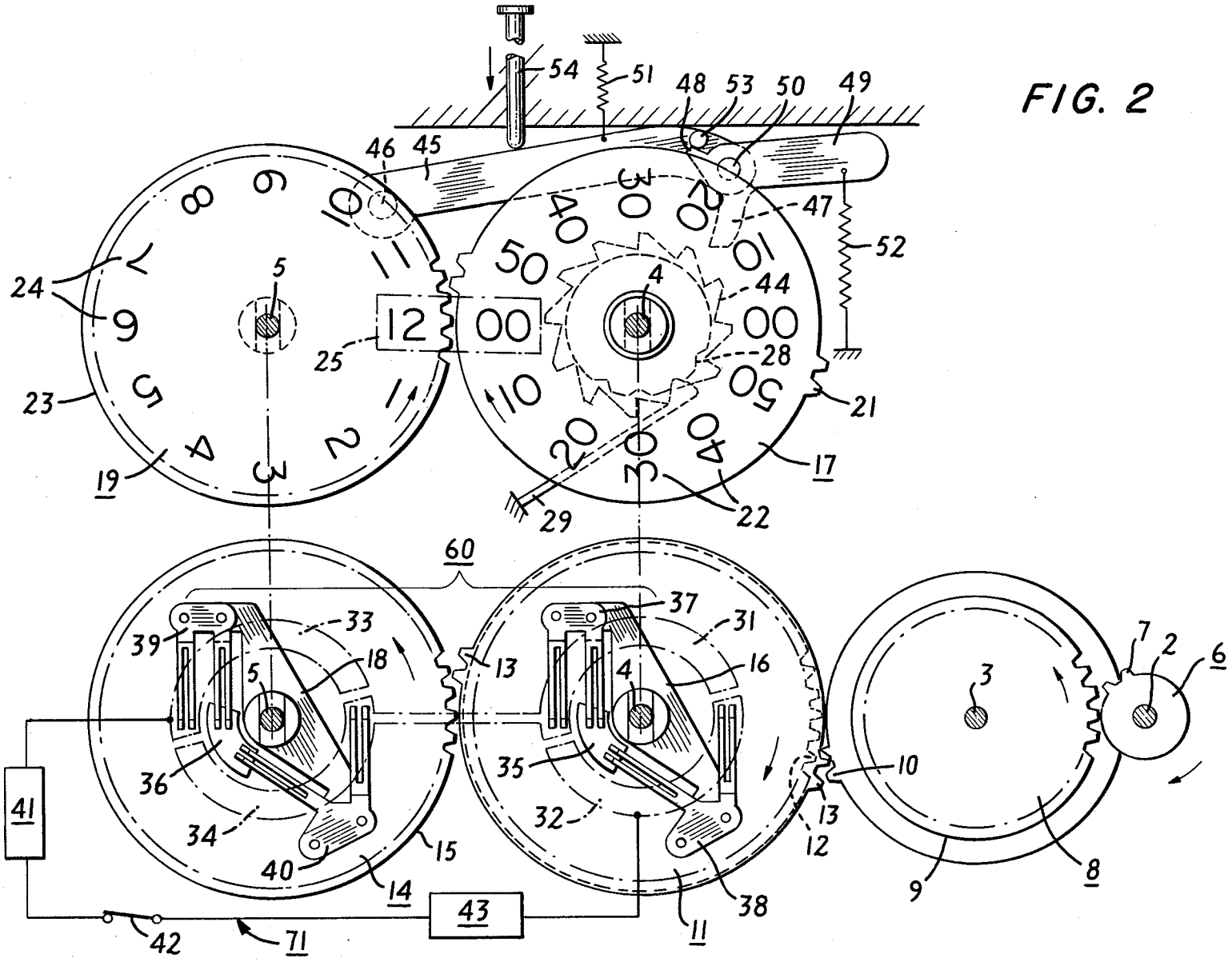
FIG. 2 is a front view of an alarm time indicating wheel section and a time wheel section, these sections being shown separately of each other.

The clock mechanism will be described. Referring to FIGS. 1 and 2, pins 2, 3, 4 and 5 are erected in a row from a base 1. A drive wheel 6 having a shift gear 7 consisting of two teeth is rotatably mounted on the pin 2. Rotatably mounted on the pin 3 is a minute time wheel 8 having a continuous gear 9 meshing with the afore-said shift gear 7 and also having a shift gear 10 consisting of wo teeth. Rotatably mounted on the pin 4 is a 10-minute time wheel 11 having a continuous gear 12 meshing with the afore-said shift gear 10 and also having a shift gear 13 consisting of two tooth sets each consisting of two teeth disposed at diametrically opposite locations on the gear 13. Rotatably mounted on the pin 5 is an hour time wheel 14 having a continuous gear 15 meshing with the afore-said shift gear 13. When the drive wheel 6 is driven, for instance from a synchronous motor (not shown), the individual driven wheels are intermittently rotated, with the 10-minute wheel 11 being rotated by 36° for each step and the 10-minute and hour wheels 11 and 14 being rotated by 30° for each step.

The call time system includes an alarm time indicating mechanism, an alarm time detecting mechanism and a call time alarming mechanism.

The alarm time indicating mechanism will first be described. A alarm time 10-minute detection member 16 and an alarm time 10-minute indicating wheel 17 keyed thereto at 16′ are rotatably supported on the pin 4, and an alarm time hour detection member 18 and an alarm time hour indicating wheel 19 keyed thereto at 18′ are rotatably supported on the pin 5. The call time 10-minute indicating wheel 17 has a shift gear 21 consisting of two diametrically opposite tooth sets each consisting of two teeth, and its top surface bears 10-minute indicating figures "00," "10," "20," "30," "40,", "50" and "60," these figures being generally indicated at 22 and spaced at pheripheral intervals subtending 30°. The alarm time hour indicating wheel 19 has a continuous gear 23 meshing with the afore-said shift gear 21, and its top surface bears hour indicating figures "1," "2" . . . "12" generally indicated at 24. Each 10-minute indicating figure 22 and each hour indicating figure 24 are adapted to appear at a display window 25 provided in a cover 26 of the clock. The alarm time 10-minute indicating wheel 17 is provided with a knob 27 projecting to the outside of the cover. Designated at 28 is a clock wheel integral with the alarm time 10-minute indicating wheel 17, and a click member 29 engages with the wheel 17.

The alarm time detecting mechanism will now be described. Designated at 30 is a base extending between time wheel 11 and indicating wheel 17 and also between time wheel 14 and indicating wheel 19. The base 30 is provided on its underside with a pair of semi-annular fixed contacts 31 and 32 of a 10-minute switch, these contacts lying in a circle concentric with the pin 4, and also a pair of semi-annular fixed contacts 33 and 34 of an hour switch, these contacts lying in a circule concentric with the pin 5. The time wheels 11 and 14 are provided on their top with respective small arcuate contacts 35 and 36, the contact 35 belonging to the 10-minute switch and located on the inner side of the circle defined by the semi-annular contacts 31 and 32 and the contact 36 belonging to the hour switch and located on the inner side of the circle defined by the semi-annular contacts 33 and 34. The alarm time 10-minute detection member 16 is provided with integral contact pieces 37 and 38 belonging to the 10-minute switch and individually having two legs. The legs of the contact piece 37 are adapted to contact the respective contacts 31 and 35, while the legs of the contact piece 38 are adapted to contact the respective contacts 32 and 35. The alarm time hour detection member 18 is provided with integral contact pieces 39 and 40 belonging to the hour switch and individually having two legs. The legs of the contact piece 39 are adapted to contact the respective contacts 33 and 36, while the legs of the contact piece 40 are adapted to contact the respective contacts 34 and 36. These contacts and contact pieces constitute a switch mechanism generally designated at 60.

The call time alarming mechanism comprises the aforementioned switch mechanism 60 and a buzzer circuit 71 including a power source 41, a main switch 42 and a buzzer 43. The main switch 42 is on-off operated by an ordinary alarm set operating means.

The call time setter will now be described. The alarm time 10-minute indicating wheel 17 is provided with an integral ratchet wheel 44. Facing the ratchet wheel 44 is a call pawl 47 pivoted by a pin 50 to one end of a driving lever 45 pivoted at the other end by a pin 46 to the base 30. The pawl 47 is substantially T-shaped and has arms 48 and 49. The driving lever 45 is spring biased with a spring 51 in the counter-clockwise direction in FIG. 2., and the call pawl is spring biased with a spring 52 in the clockwise direction. The driving lever 45 is provided with a stopper 53, which is adapted to engage with the arm 48 of the pawl 47 to thereby restrict the swing of the pawl in the clockwise direction.

Designated at 54 is a call time setter pin for stopping the alarming of the call time and setting the next call time. It is supported such that its one end faces an intermediate portion of the driving lever 45, with its other end portion extending to the outside of the machine.

Figure 3:
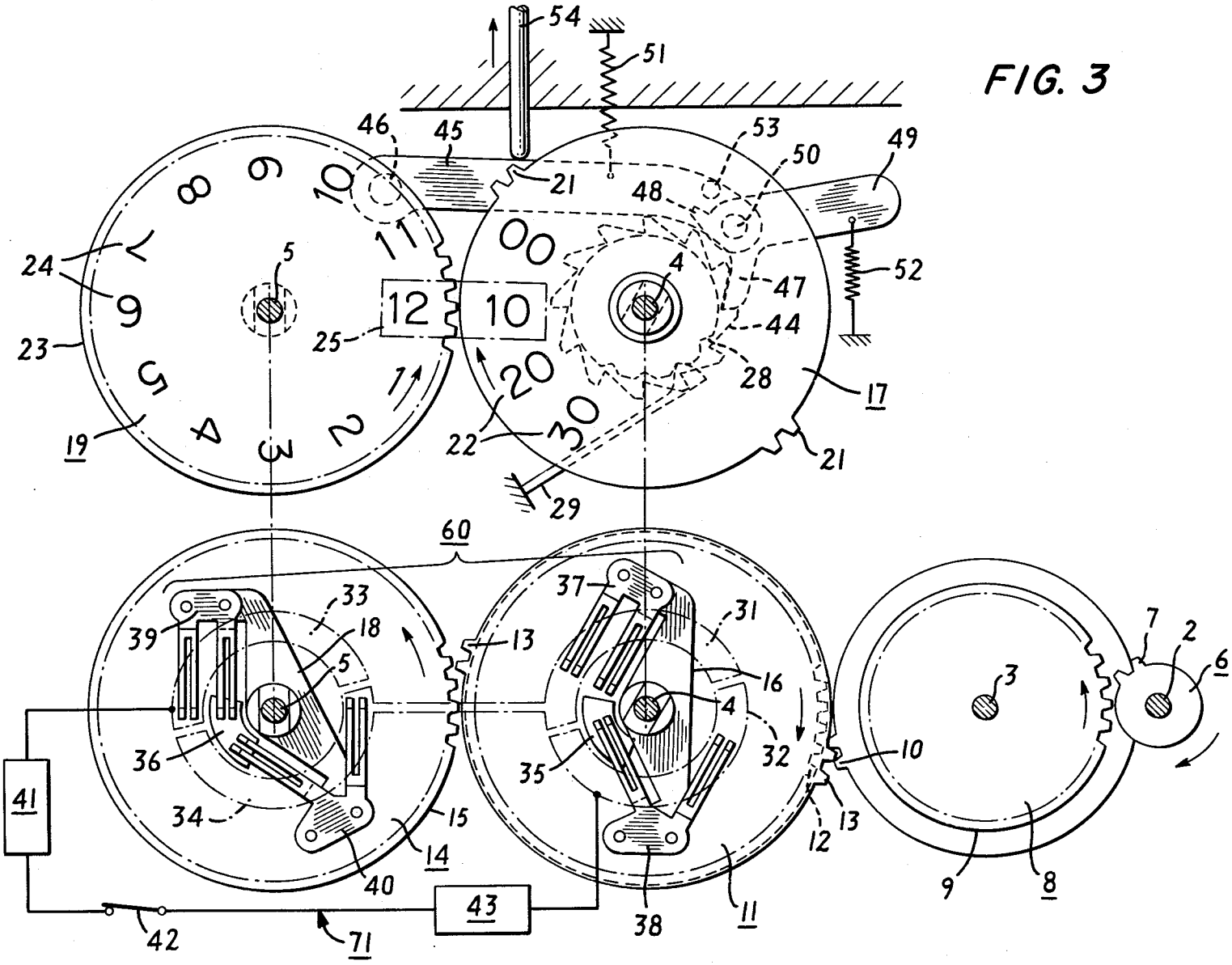
FIGS. 3 and 4 are similar front views illustrating consecutive operative stages resulting from operating the call time setter.

The call or alarm setting operation of the instant device will now be discussed. In the state of FIG. 2, the call time or alarm time of 12 o'clock is displayed on the window 25. Also, the buzzer circuit is closed, and the call time is being alarmed by the buzzer 43. In this state, by pushing the call time setter pin 54 the driving lever 45 is rotated together with the pawl 47 in the clockwise direction (i.e., toward the ratchet wheel 44), causing the pawl 47 to rotate the ratchet wheel 44 by 1 tooth pitch, i.e., 30°, in the clockwise direction. Thus, the alarm time 10-minute indicating wheel 17 is also rotated by the same amount, so that the display on the display window 25 is switched to a new call time 10 minutes lagging behind the previous one, that is, 10 minutes past 12, as shown in FIG. 3. In the meantime, with the rotation of the alarm time 10-minute indicating wheel 17 the alarm time 10-minute detection member 16 is also rotated the same amount to make a phase difference of 30° with respect to the 10-minute time wheel 11, while separating the contact piece 37 from the contact 35 to open the buzzer circuit. As a result, the audible alarm is stopped.

Figure 4:
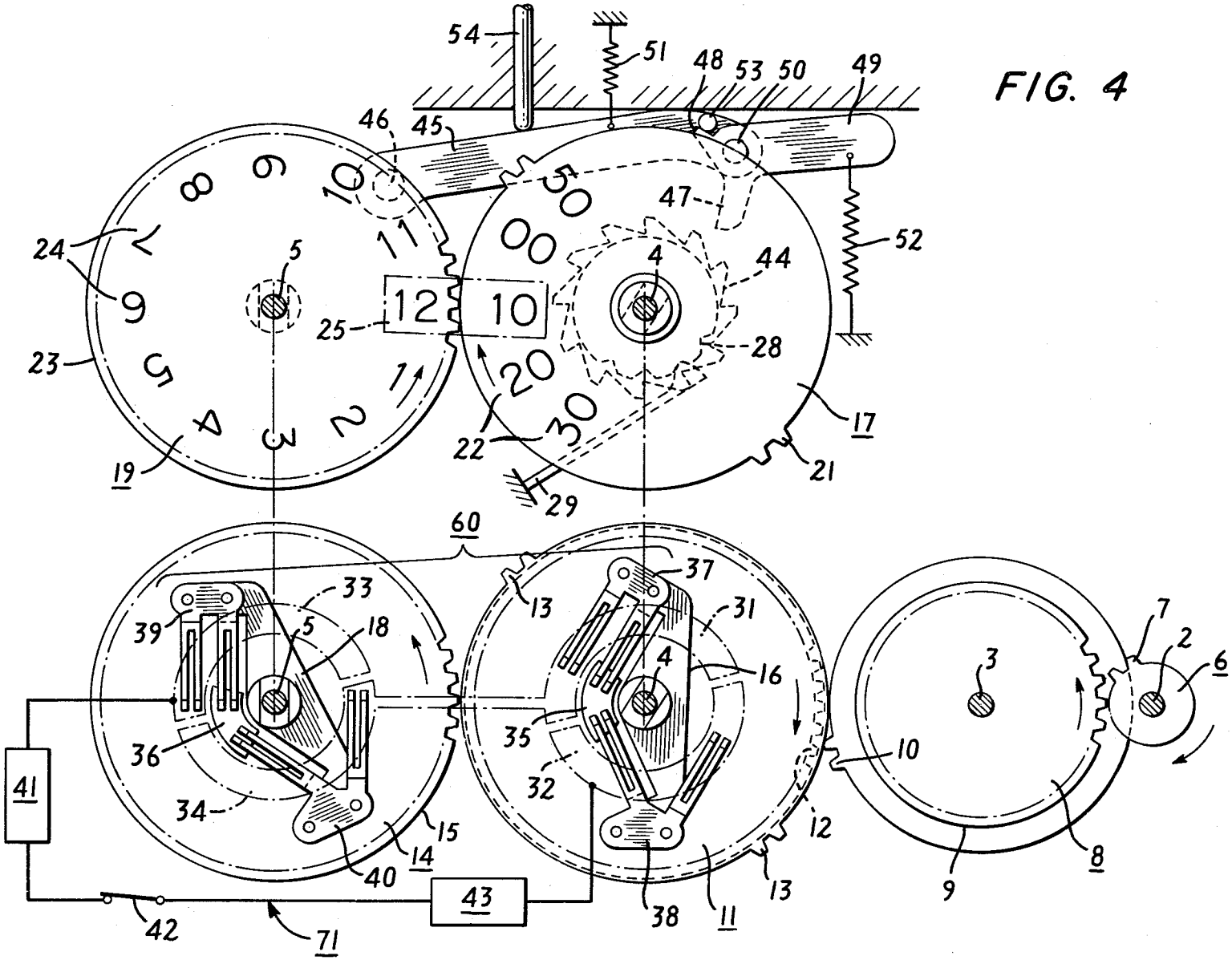

Ten minutes thereafter, the 10-minute time wheel 11 moves in phase with the detection member 16 due to its rotation by 30° in the clockwise direction, as shown in FIG. 4. At this moment, the contact 35 is also rotated to a position to contact both the contact pieces 37 and 38, thus closing the buzzer circuit gain to effect the alarming of the new call time.

If it is desired to set a call time 20 minutes lagging behind (20 minutes past 12 in the above case), 30 minutes laggaing behind (30 minutes past 12) and so forth, the call time setter pin 54 is pushed twice, three times and so forth. By so doing, the call time of 20 minutes past 12, 30 minutes past 12 and so forth is displayed on the display window 25, and also the detection member 16 is rotated to a position of the corresponding phase.

Further, if it is desired to set a call time more than 60 minutes lagging behind in the above example, the alarm time hour indicating wheel 19 is also rotated by a given angle, thus rotating the alarm time hour detection member 18 by the same given angle to be ready for the alarming of the set call time.

Figure 5:
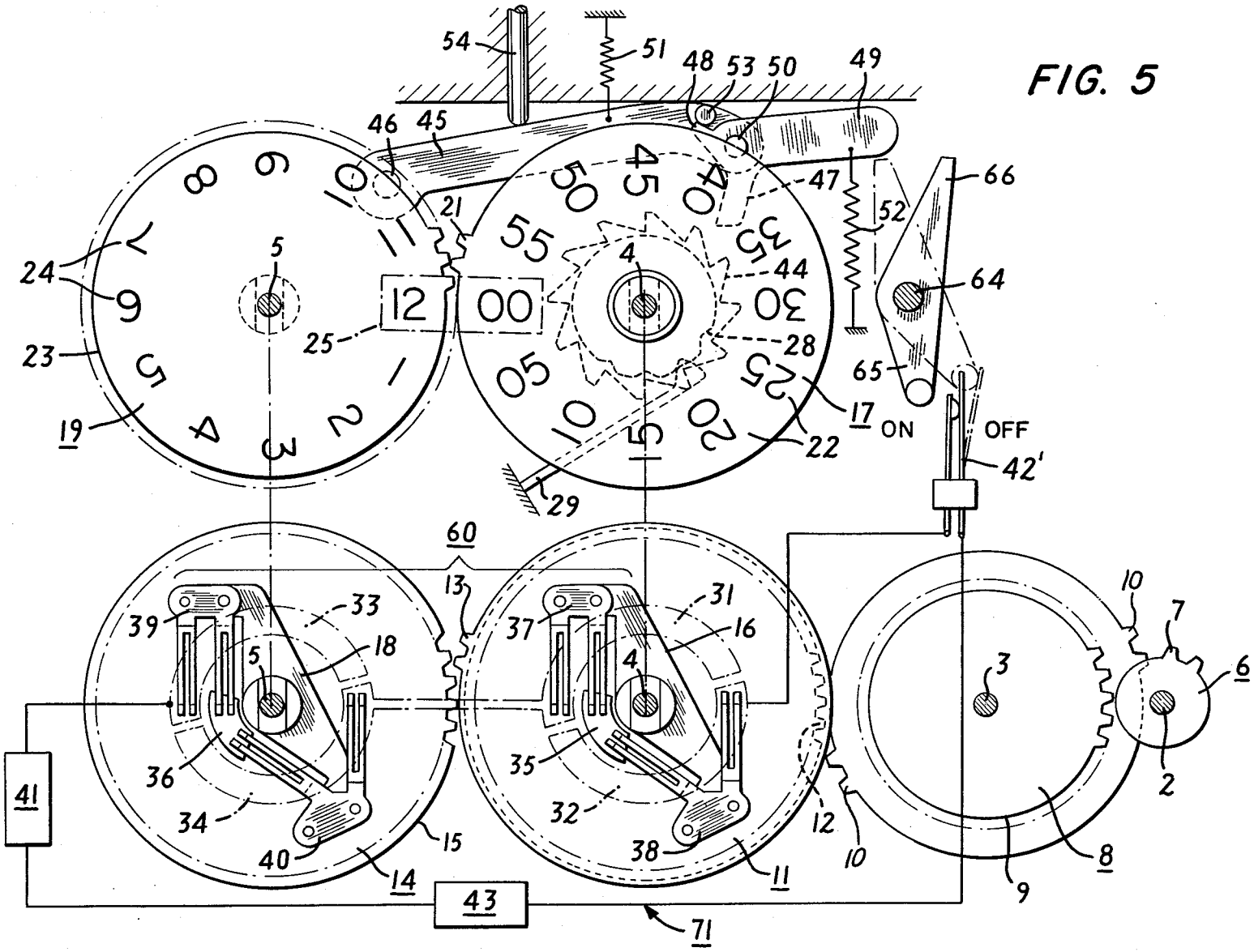
FIG. 5 is a similar front view showing a call time system having a locking mechanism.

While the unit interval of call time settings has been 10 minutes in the above embodiment, this is by no means limitative; for example, it may be modified to 5 minutes, 3 minutes and so forth. FIG. 5 shows another example, in which the unit call time interval is made to be 5 minutes. In this example, the shaft gear 10 of the minute time wheel 8 consists of two diametricaly opposite tooth sets each consisting of two teeth, the shift gear 13 of the 10-minute time wheel 11 consists of only a single tooth set, and the shift gear 21 of the alarm time 10-minute indicating wheel 17 consists of only a single tooth set. Also, the display figures on the indicating wheel 17 are provided with a unit interval of 5 minutes.

Further, the alarm time detecting mechanism may use various mechanical constructions. In an example shown in FIG. 6, the 10-minute and hour time wheels 11 and 14 are provided with respective top side grooves 55 and 56. Also, alarm time 10-minute and hour detection members 16' and 18' rotatably supported on respective pins 4 and 5 have a disc-like form, and they have respective projections 57 and 58 engageable in the associated grooves 55 and 56. Similar to the preceding examples, they are secured to respective 10-minute and hour indicating wheels 17 and 19. Extending above the detection members 16 and 18 is a substantially T-shaped call time switch actuating member 59, with its opposite ends supported on the respective pins 4 and 5. The switch actuating member 59 is spring biased by means of springs (not shown) toward the detection members 16 and 18, and the tip of its arm 61 extends to a position to on-off operate a switch 60 consisting of contacts 62 and 63.

Now, call time systems having a locking mechanism will be described. This is intended lest the already preset call time should be altered if the call time setter pin 54 is pushed by mistake in the "off" state of the alarm set. In the example of FIG. 5, the main switch 42' of the buzzer circuit is disposed in the vicinity of the arm 49 of the pawl 47, and a switch actuating lever 65 is secured to a pin 64 located at an intermediate position between the switch 42 and arm 49 and interlocked to the alarm set. The switch actuating lever 65 has a lock arm 66 adapted to engage with the afore-said arm 49. When the switch actuating lever 65 is rotated in the counter-clockwise direction in FIG. 5 by a suitable alarm set operating means, the endmost portion of the switch actuating lever 65 engages and opens the switch 42 to render the alarm set "off." At the same time, the lock arm 66 is brought to a position where its top is under the arm 49, whereby at the time of pushing the call time setter pin 54 the pawl 47 will swing about the pin 50 in the counter-clockwise direction to avoid engagement with the ratchet wheel 44. Thus, at this time the time wheel 11 will not be rotated, and hence the call time will not be altered.

Figure 6:
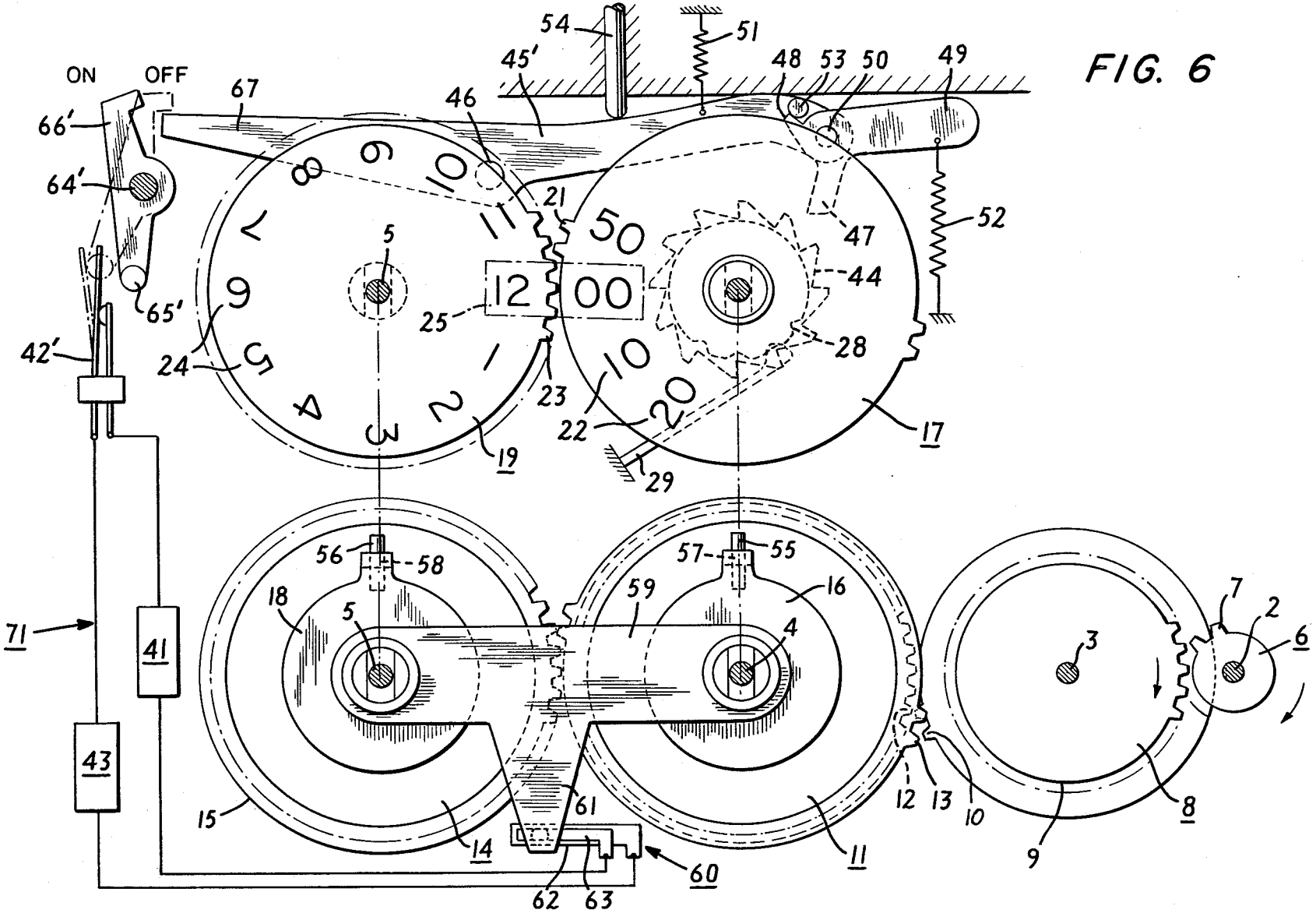
FIG. 6 is a similar front view showing a call time system having a mechanical call time detection mechanism and another type of locking mechanism.

In another example of the locking mechanism shown in FIG. 6, a lock arm 66' is made engageable with an arm 67 extending from the stem of the driving lever 45'.

In FIG. 1, numerals 68, 69 and 70 designate contacts in contact with contact members provided on the underside of the respective tine wheels 8, 11 and 14, and through these contacts a clock time display mechanism (not shown) is operated.

As has been shown, according to one aspect of the invention, the desired call time setting operation can be obtained by making use of most of the parts of the mechanism used in the prior-art call time system and by merely adding an actuating member for stopping the alarming and setting of the call time. Thus, the mechanism is extremely simplified, which is advantageous in view of the space factor and cost. Further, according to the invention the call time detection members can be displaced step by step for unit displacement in phase with each other by repeatedly operating the actuating member. By so doing, the user can freely alter the call time interval to suit his desire, which is very convenient in use.

According to another aspect of the invention, it is possible to correctly notify the preset call time set by the call time setting operation. Besides, the display of the preset call time is possible even in the case where the call time setter is repeatedly actuated to set a new call time.

According to a further aspect of the invention, the locking member automatically locks the call time setter in an inoperative state when the call time system is rendered inoperative by the alarm set operating means. Thus, even if the call time setter member is pushed by mistake after the setting of a call time, the preset call time will not be altered.

What we claim is:

1. In an alarm device in a clock mechanism: rotationally driven time wheels; alarm time detection means selectively displaceable at constant increments to a position at a desired phase with respect to said time wheels and coacting with said time wheels to set a predetermined alarm time to be detected and including sliding switch means connected to said time wheels for movement therewith and slidable to an open position during setting of the predetermined alarm time and slidable to a closed position upon detection of the predetermined alarm time; alarm time indicating means having externally visible alarm time display marks spaced at intervals corresponding to the constant increments of displacement of said alarm time detection means for indicating in digital form the predetermined alarm time; alarming means coacting with said sliding switch means for sounding an audible alarm when the alarm time detection means and time wheels come into phase with each other and said sliding switch means is in said closed position; alarm time setter means including an actuating member operative when actuated for stopping the audible alarm and setting a new alarm time, said actuating member being movably supported and engageable with said alarm time detection means; and means for effecting displacement of said alarm time detection means by a constant phase increment in response to each actuation of said actuating member.

2. In an alarm device in a clock mechanism: rotationally driven time wheels; alarm time detection means selectively displaceable at constant increments to a position at a desired phase with respect to said time wheels and coacting with said time wheels to set a predetermined alarm time to be detected; alarm time indicating means having externally visible alarm time display marks spaced at intervals corresponding to the constant increments of displacement of said alarm time detection means for indicating in digital form the predetermined alarm time; alarming means for sounding an audible alarm when the alarm time detection means and time wheels come into phase with each other; alarm time setter means including an actuating member operative when actuating for stopping the audible alarm and setting a new alarm time, said actuating member being movably supported and engageable with said alarm time detection means; means for effecting displacement of said alarm detection means by a constant phase increment in response to each actuatiion of said actuating member; and alarm set operating means movable to selectively render said alarm device operative or inoperative, said alarm set operating means including a locking member movable to a position to prevent engagement between said actuating member and said alarm time detection means in accordance with the selective movement of said alarm set operating means.

3. In an alarm device of a clock mechanism: at least one rotationally driven rotary time wheel; alarm time detecting means mounted for movement relative to and coacting with said time wheel and selectively settable to detect when said time wheel reaches a predetermined angular position corresponding to a preselected alarm time; alarm means operative in response to detection of said preselected alarm time for providing an alarm signal; manually actuated means for terminating said alarm signal and simultaneously resetting said alarm time detecting means to detect a new alarm time, said manually actuated means including a manually depressable member, and means responsive to each depression of said depressable member to effect movement of said alarm time detecting means a constant increment relative to said time wheel to thereby reset said alarm time detecting means to detect a new alarm time dependent upon the number of times said depressable member has been depressed; and means for selectively rendering said depressable member ineffective to effect movement of said alarm time detecting means despite depression of said depressable member.

4. An alarm device according to claim 3; including alarm time indicating means for indicating the alarm time set to be detected by said alarm time detecting means.

5. An alarm device according to claim 3; wherein said alarm time detecting means includes a slide switch having a set of stationary contacts electrically connected to said alarm means, and a detection member connected to one of said time wheels for movement therewith and slidable into electrical contact with said contacts to detect said preselected alarm time during movement of said one time wheel.

6. The alarm device according to claim 1; including means for effecting displacement of said alarm time indicating means in response to the operation of said actuating member.

* * * * *